US007838449B2

(12) United States Patent
Black et al.

(10) Patent No.: US 7,838,449 B2
(45) Date of Patent: Nov. 23, 2010

(54) DRYER SHEETS INCLUDING BICOMPONENT FIBERS

(75) Inventors: Samuel Keith Black, Raleigh, NC (US); Terezie Zapletalova, Raleigh, NC (US); John McNabb, Raleigh, NC (US); Jeffrey Stine, Wake Forest, NC (US)

(73) Assignee: Freudenberg Spunweb Company, Durham, NC (US)

( * ) Notice: Subject to any disclaimer, the term of this patent is extended or adjusted under 35 U.S.C. 154(b) by 224 days.

(21) Appl. No.: 12/129,415

(22) Filed: May 29, 2008

(65) Prior Publication Data

US 2009/0297809 A1 Dec. 3, 2009

(51) Int. Cl.
*D04H 1/00* (2006.01)
*D04H 13/00* (2006.01)
*D04H 3/00* (2006.01)

(52) U.S. Cl. ..... 442/361; 442/362; 442/363; 442/364; 442/59; 442/164; 264/123

(58) Field of Classification Search ..... 442/361–364, 442/340, 59, 164; 264/123
See application file for complete search history.

(56) References Cited

U.S. PATENT DOCUMENTS

| | | | | |
|---|---|---|---|---|
| 5,080,810 | A | 1/1992 | Smith | |
| 5,082,720 | A * | 1/1992 | Hayes | 442/362 |
| 5,470,492 | A | 11/1995 | Childs | |
| 5,883,069 | A | 3/1999 | Childs | |
| 5,929,026 | A | 7/1999 | Childs | |
| 6,357,137 | B1 | 3/2002 | Childs | |
| 6,461,386 | B1 | 10/2002 | Chan | |
| 6,755,987 | B1 | 6/2004 | Hubesch | |
| 6,887,841 | B2 | 5/2005 | Mattia | |
| 6,930,082 | B2 | 8/2005 | Harichian | |
| 2003/0181346 | A1 | 9/2003 | Harichian | |
| 2003/0207785 | A1 | 11/2003 | Mattia | |
| 2004/0023828 | A1 | 2/2004 | Grippo | |
| 2007/0015676 | A1 | 1/2007 | Ogden | |
| 2007/0256253 | A1 | 11/2007 | Ogden | |
| 2009/0144913 | A1 * | 6/2009 | Yu et al. | 8/137 |

* cited by examiner

*Primary Examiner*—Norca L Torres-Velazquez
(74) *Attorney, Agent, or Firm*—Grossman, Tucker, Perreault & Pfleger, PLLC

(57) ABSTRACT

A dryer sheet substrate is provided having improved loft and reduced fuzz wherein the substrate comprises relatively low denier bicomponent fibers. The bicomponent fibers may comprise two or more polymers having different melting temperatures, with the relatively lower melting temperature polymer making up at least a portion of the outer surface of the fiber. Upon heating to a sufficient temperature, the lower melting temperature fibers may soften and melt, providing bonding at crossover points of the fibers in the laid web. The web indicates advantageous characteristics with respect to thickness (loft), fuzz factor and ability to absorb a fabric treating composition.

17 Claims, 1 Drawing Sheet

DRYER SHEETS INCLUDING BICOMPONENT FIBERS

FIELD

The present disclosure relates to articles for providing fabric care, particularly laundry dryer sheets, and more particularly, to dryer sheets which include bicomponent fibers.

BACKGROUND

A laundry dryer sheet may have multiple purposes. As a main purpose, the sheet may soften the articles of the drying load, and may reduce the presence of static electricity, commonly known as "static cling". The dryer sheet may be treated with softening agents, which when released may provide a lubrication effect that gives the articles similar surface make-up. This lubrication effect not only may soften the articles, but may aid in reducing the presence of static electricity by limiting the exchange of electrons among the articles.

Fabric treating compositions have been developed which are capable of imparting one or more of a variety of properties to articles of clothing, such as softness, fragrance, brightening, bodying, reduced static, anti-soiling, anti-creasing and others. Dryer sheets including such compositions may generally comprise sheets of material impregnated with, for instance, a composition usually consisting of a cationic softening agent, antistatic agents, dispersing agents and a fragrance, which may be in semi-solid (wax) form (at room temperature). The softening or other fabric treating agent may be applied to the non-woven material and then solidified by contacting a relatively cool surface so that it is ready for use. One or more dryer sheets may be placed within a rotary clothes dryer with freshly laundered, damp items of clothing, where they may remain for the entire drying cycle. The composition on the sheet of material may be released in the course of the drying cycle as a result of the heat within the clothes dryer, through contact with the dampness of the undried clothing and/or contact with the clothing induced by the tumbling action of the dryer.

A wide variety of active ingredients may also be employed in a fabric treating composition or agent depending upon the particular property or properties to be imparted to the clothing. Such active ingredients may include, for instance, anti-creasing agents, anti-soil agents, bacteriostatic agents, brightening agents, bodying agents, softening agents, dyes, fiber emollients, finishing agents, fragrances, insect repellants, germicides, lubricants, mildew-proofing agents, moth-proofing agents, shrinkage controllers and sizing agents. Additional materials may also be included in the composition, such as preservatives, anti-static agents, fragrances and others.

SUMMARY

In a first exemplary embodiment, the present disclosure relates to a non-woven web including bicomponent fibers, including a belt side and jet side, wherein the bicomponent fibers comprise two or more polymers. One portion of the bicomponent fiber comprises a polymer having a melting temperature, $Tm_1$, and another portion of the bicomponent fiber comprises a polymer having a melting temperature, $Tm_2$, wherein $Tm_1<Tm_2$ and wherein said bicomponent fibers have a denier of 1.2 to 3.0, and the web has a thickness of greater than 0.10 mm and up to 0.40 mm and a fuzz factor on said belt side and/or jet side of less than 0.90. The web is further characterized as being capable to absorbs an applied coating at a level between 6.0 grams/$m^2$ to 50 grams/$m^2$, and the web is one that may be used as a laundry dryer sheet, wherein the coating is one that can be desirably released during its residence in a clothes dryer upon exposure to a selected hot air cycle.

In method form, the present disclosure relates to a process for providing a substrate for use as a laundry dryer sheet, comprising providing two or more polymers, wherein at least one of the two or more polymers has a melting temperature, $Tm_1$, lower than the melting temperature, $Tm_2$ of another polymer of the two or more polymers. This may then be followed by extruding the two or more polymers together to form bicomponent filaments, wherein said one polymer having a lower melting temperature, $Tm_1$, forms at least a portion of the outer surface of the filament. This may then be followed by positioning the bicomponent filaments onto a conveyor to form a web, where the web will then have a jet side and belt side, and passing the web past a source of heat such that the lower melting temperature polymer softens and bonds the bicomponent filaments together. The bicomponent filaments may have a have a denier of 1.2 to 3.0, and the web has a thickness of greater than 0.10 mm and up to 0.40 mm and a jet side and/or belt side fuzz factor of less than 0.90.

BRIEF DESCRIPTION OF THE DRAWING

The features, operation and advantages of the invention may be better understood from the following detailed description of the preferred embodiments taken in conjunction with the attached drawing, in which.

DETAILED DESCRIPTION

Figure 1:
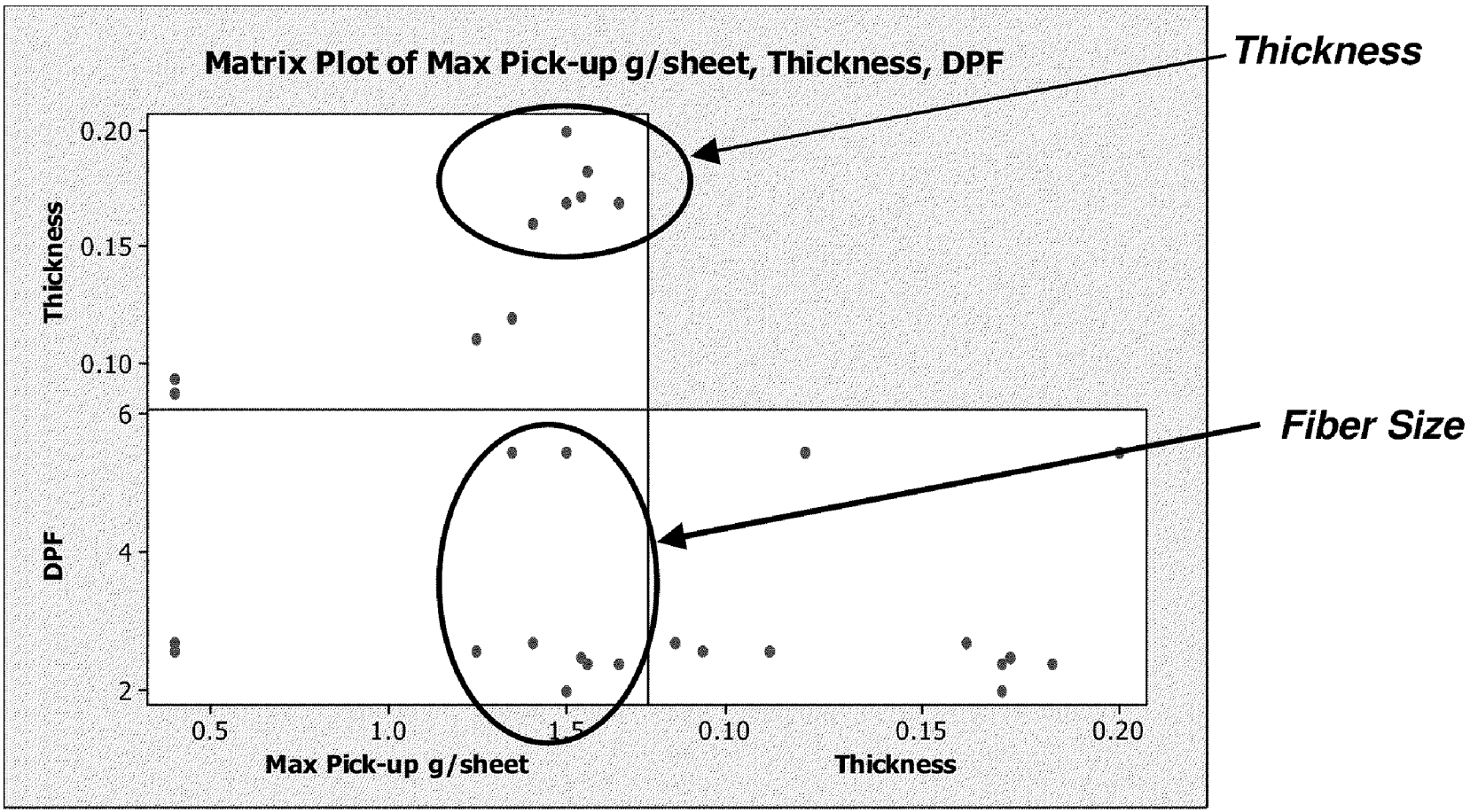
FIG. 1 is a plot that indicates thickness, DPF (denier per fiber at g/9000 meters), versus maximum pick-up in grams per sheet, the sheet having a surface area of 377.4 square centimeters.

Still other objects and advantages of the present disclosure will become readily apparent to those skilled in the art from the following detailed description, wherein preferred embodiments of the disclosure are shown and described, and as illustration of the best mode contemplated of carrying out the disclosure. As will be realized by the skilled person, the disclosure is capable of other and different embodiments, and its details are capable of modifications in various respects, without departing from the disclosure.

Dryer sheets herein may comprise a substrate of non-woven fibers. The non-woven fibers may be impregnated with one or more materials which may impart a specific property to clothes in a clothes dryer, due to the heat within the clothes dryer, through contact with the dampness of the undried clothing and/or contact with the clothing induced by the tumbling action of the dryer. The present disclosure is directed at the use of a non-woven substrate formed from bicomponent fibers which have been laid on a conveyor and heated to bond the fibers together at crossover points for use as a dryer sheet substrate. By "crossover point" it is meant to describe discrete location where one filament may be lying across, for instance at an angle, to another fiber such that upon heating the two filaments may contact one another and upon softening, bond together.

Bicomponent fibers are defined herein to mean fibers comprising two or more polymers which have been extruded into a filament wherein the two or more polymers have melting points different one from the other. In such process, the bicomponent fiber or filament may include one component with a melting point of $Tm_1$, and one component with a melting point $Tm_2$, wherein $Tm_1<Tm_2$. Such filaments may have a geometric makeup including but not limited to, sheath/core, side-by-side, islands-in-the-sea, matrix-fibril, segment/pie or striped configuration. Furthermore, the filaments may have a round, oval, trilobal, triangular, dog-boned, flat or hollow shape and/or a symmetrical or asymmetrical (eccentric) sheath/core or side-by-side configuration.

Bicomponent fibers may be produced by extruding two polymers from the same spinnerette with both polymers contained within the same filament. While there are a number of constructions of bicomponent fibers as noted above, a sheath/core construction is preferred in the present disclosure wherein the surrounding sheath portion comprises a polymer having a lower melting temperature, $Tm_1$, than the melting temperature, $Tm_2$, of the polymer of the core portion. Such relatively lower melting temperature thereby affords the ability of such fibers to effectively bond together when exposed to, e.g., a hot air treatment, as discussed more fully below.

It has been found that a dryer sheet, of the bicomponent configuration, may desirably have certain other physical property characteristics. For example, it has been found that the bicomponent fibers may have a denier of 1.2-3.0, including all values and increments therein. For example, the fibers may have a denier of 1.5 to 2.5, or the fibers may have a denier of 2.0. Denier may be understood as the weight in grams of 9000 meters of fiber. Accordingly, it has been established that this particular range of denier provides the ability to generate a particularly desirable loft. Loft may be understood as the thickness that the web immediately provides after thermal bonding and which may then influence the absorption of the fabric treating composition.

As alluded to above, the fabric treating composition may amount to a chemical additive that imparts one or more of a variety of properties to articles of clothing when exposed to the web during drying in a dryer, such as softness, fragrance, brightening, bodying, reduced static, anti-soiling, anti-creasing and others. Typically, the fabric treating composition is one that may be understood as being a wax at room temperature, i.e. in a semi-solid state.

In addition, the webs herein indicate a relatively desirable "fuzz-factor" performance, also discussed below. It may initially be noted that "fuzz factor" refers to an evaluation of the relative tendency of the web to have protruding or dislodging fibers above the surface as a consequence of moderate abrasion caused by sliding a rubber surface of a given weight (e.g. 1000 grams) across the surface of the web four (4) times (lengthwise, crosswise and both diagonal directions). It may therefore be appreciated that fuzz factor may reliably indicate the relative integrity of the web and its relative resistance to tumbling action in a dryer in the presence of clothing.

To provide such a dryer substrate sheet for impregnation, the two or more polymers having differing melting temperatures may first be fed to an extruder having a head configured to produce the filament configuration desired, and a web laid onto a conveyor by such processes as melt spinning, flash spinning, melt blowing, etc. The conveyor may comprise a foraminous screen that air may be drawn through.

Following preparation of the "as-layed" web, the web may be consolidated by heating to a temperature where the relatively low melt temperature polymer of the bicomponent fibers may soften (flow) and/or melt and bind the fibers together. Heating may generally be conducted by infrared heating, for example using commercially available radiant panels, or via a hot air knife (i.e. a directed flow of hot air) followed by heating in an oven to a temperature sufficient to soften and/or fuse the low melting polymer of the bicomponent fibers.

The relatively "low melt temperature polymer" refers to a polymer having a melting temperature, $Tm_1$, at which the lower melting polymer softens and/or melts to the degree necessary to bind the fibers and other constituents of the non-woven web together. The other portion of the bicomponent fiber may comprise a polymer having a relatively higher melting temperature, $Tm_2$, wherein $Tm_1<Tm_2$ When the web is heated to bind the fibers together, the lower melting temperature polymer may soften and act as a binding agent for the higher melting temperature polymer, which may provide structure to the web. For example, the as-layed web on a foraminous conveyor may be exposed to hot air in the range of 160-200° C., including all values and increment therein. Accordingly, the hot air may specifically be set to about 185° C., followed by transferring the web through an oven heated to 210-240° C., including all values and increments therein. For example, one may use a heated over set to about 230° C.

The preferred bicomponent fibers are bicomponent fibers comprising a relatively higher melting polymer, for instance a polyester such as poly(ethylene terephthalate) (PET), and a relatively lower melting polymer, for instance a copolyester such as a copolymer of poly(ethylene terephthalate) and poly (ethylene adipate) or a copolymer formed from the combination (polymerization) of dimethyl terephthalate (DMT), ethylene glycol (EG) and adipic acid, which may then provide a polyester having PET type repeating structure as well as repeating polyester structure containing aliphatic type polyester segments. Accordingly, it may be understood herein that the relatively lower melting polyester fiber is one that contains aromatic polyester repeating units and aliphatic polyester repeating units. Such copolyesters may provide a relatively lower melting temperature portion of a bicomponent fiber and allow bonding of the fibers when used as a portion of the outer (sheath) surface.

However, bicomponent fibers comprising other combinations of polymers may be useful as well and are contemplated herein. As noted, the dryer sheet substrate of the present disclosure may comprise about 10 to about 100 percent by weight of the bicomponent fibers, the 100 percent level referring to that exemplary embodiment where the substrate may be composed entirely of the bicomponent fibers, and wherein the numbers less than 100 percent correspond to that exemplary embodiment which includes other natural or synthetic fibers interspersed with the bicomponent fibers. Accordingly, in the event that the bicomponent fibers do not comprise 100 percent of the substrate, and a natural or synthetic fiber may be employed, such natural or synthetic component may be present at any corresponding level to make-up for the reduction from 100% for the bicomponent fiber component. However, in one exemplary embodiment, the bicomponent fiber component may be present at levels of about 10-100 percent, or at any other individual percentage or range, e.g., at a level of about 40 percent to 60 percent by weight.

With respect to the difference in melting points, and by way of example, a polymer having a melting point, $Tm_2$, of about 255° C. was employed as the core and a polymer having a melting point, $Tm_2$, of about 225° C. was employed as the sheath component in a sheath/core configuration. This, of course, amounts to a different in melting points of about 30° C. However, $Tm_2$ minus $Tm_1$ ($Tm_2-Tm_1$) ranging between about 15° C. to about 60° C. is contemplated herein. In addition, reference to melting point temperature (Tm) may be understood as the peak temperature in a melting endotherm profile as measured by differential scanning calorimetry at a heating rate of about 5° C./minute.

Furthermore, it is worth noting that the relatively lower melting temperature polymer may make up at least a portion of the outer surface of the bicomponent fiber. In this manner, subsequent heating may cause the fibers to soften and at least partially melt, and achieve a minimum flow suitable to provide (upon cooling) bonding at crossover points of the fibers in the laid web.

The following Tables 1a and 1b illustrates comparative examples of the relative improvement in the features of "loft" and "fuzz factor" obtained using bicomponent fibers noted above as a dryer sheet substrate:

TABLE 1a

| Fiber type | Pre-bonding | Thickness [mm] | Highest pickup rate [g/sheet] | Coating performance |
|---|---|---|---|---|
| Mixed Bico | PB | 0.20 | 1.50 | + |
| Mixed Bico | RSS | 0.12 | 1.35 | – |
| Mono - 100% PET | PB | 0.17 | 1.50 | + |
| 100% Bico | SS | 0.09 | 0.40 | – |
| 100% Bico | RSS | 0.11 | 1.25 | – |
| 100% Bico | PB | 0.18 | 1.56 | + |
| 100% Bico | Hot air | 0.26 | 1.50 | + |

TABLE 1b

| Fiber type | Fuzz Factor | Fuzz factor | Comment | Overall Performance* |
|---|---|---|---|---|
| Mixed Bico | 1.83 | – | | – |
| Mixed Bico | 0.5 | + | | – |
| Mono - 100% PET | 1.625 | – | Not acceptable - showing PB pattern | |
| 100% Bico | 0.9 | + | | – |
| 100% Bico | 0.7 | + | | – |
| 100% Bico | <1 | + | Not acceptable - showing PB pattern | |
| 100% Bico | <0.9 | + | | + |

*"+" indicates that the sample passed and "–" indicates that the sample failed

As shown in Table 1, the use of a 100% bicomponent fiber web, that is exposed to a prebonding with a hot air knife (to bond the outer and relatively lower melting fibers in a sheath-core construction), at a thickness of 0.26 mm, provided a pickup of about 1.50 grams for a sheet having a surface area of about 377.4 $cm^2$. This corresponds to a pick-up of the applied dryer sheet coating at a level of about 6.0 grams/$m^2$ to 50 grams/$m^2$. In addition, the fuzz factor of such bicomponent web (jet size and/or belt side) was found to be consistently less than 0.90.

This bicomponent web was also found to provide favorable coating performance with respect to the above referenced chemical additive that as noted, imparts one or more of a variety of properties to articles of clothing when exposed to the web during drying in a dryer, such as softness, fragrance, brightening, bodying, reduced static, anti-soiling, anti-creasing. Expanding on this characteristic, it may be noted that the indicated bicomponent web is one that incorporates such chemical additive in relatively uniform fashion and there is also no excessive build-up of the coating transferred from the coated web on parts of the machinery in other processing steps (e.g. roller surfaces, parts of machinery coming in contact during folding and packing of the web for the dryer sheet application). In addition, it has been found that the bicomponent webs herein, when used as a dryer sheet, are such that they do not exhibit sticking to one another when residing in a given package (box).

Expanding on the metric of "fuzz factor", again, as noted it is a measure of the ability of the substrate to retain fibers after a 1000 gram weight has been pulled across the surface of the substrate in four (4) directions (lengthwise, crosswise and both diagonals). It may also be appreciated that a given web may have one side, known as the jet side, which may be understood as the side of the non-woven that does not contact the belt when the web is produced on a moving belt. The belt side fuzz factor may therefore be understood as the fuzz factor of the side of the web that contacts the belt.

Fuzz factor ratings may then vary from 0 (for no loose fibers) to 4.0 (extreme fuzz, high density of single fibers and fiber strands which are pulled out and project from the web). The fuzz factor found suitable herein for the bicomponent web, as noted, was less than 0.90, i.e. between 0-0.89, including all values and increments therein. For example, the fuzz factor of the jet side and/or belt side may be in the range of 0.10-0.30, and more specifically, have a value of about 0.20. The procedure for measuring the fuzz factor of products may be summarized as follows:

Equipment Requirements: Green Epoxy Grout Float, 9.5'×4', manufactured by Q.E.P. Co., Inc. Boca Raton, Fla., Item Number 10064. Before use, the outermost coating on the rubber bottom of the float should be removed, which may be accomplished by using relatively fine sand paper. Small weights may then be attached to the tool so that the tool weight is 1000 grams. The Grout float may be conveniently equipped with a handle by which it will be pulled over a sample with no additional pressure on the tool.

The testing protocol may therefore proceed as follows:

1. Place a sample fabric on a support surface with a test side facing up.
2. Without disturbing the sample, mark ten {10} equally spaced 8.5'×10' areas across the surface of the fabric width. The sample areas can be spaced in a staggered manner.
3. Place the Float {Tool} on the surface of the fabric so that at least the middle of the tool is placed outside of the marked area.
4. Using the attached handle pull the tool across the marked area in such a way that the middle of the tool should clear the marked area in approximately 1 sec.
5. Repeat pulling the tool over the marked area in four directions {lengthwise, crosswise, both diagonal directions}.
6. Lift the middle of the marked area by placing a palm of the hand underneath the fabric and inspect for loose filaments against a black background. Only the sample area that experienced all four strokes by the tool should be inspected. Observe fabric surface for loose fibers and fiber strands.
7. Assign a fuzz factor rating to each sample according to these directions:
   0—No fuzz
   1—Slight fuzz {just a few fibers pulled out above substrate surface}
   2—Moderate fuzz {more than a few fibers, but no fiber strands pulled out}
   3—Heavy fuzz {many fibers as well as fiber strands are pulled out}
   4—Extreme fuzz {high density of single fibers and strands are pulled out}
8. Record your rating for each tested area.
9. Fuzz factor value is computed as an average value of all assigned ratings.
10. Repeat fuzz factor test on other side of the fabric if applicable.

FIG. 1 provides a matrix plot of maximum pick-up in grams for a sheet of bicomponent fibers formed into a web, in accordance with the present disclosure. Such sheet, as noted, may provide a surface area of about 377.4 $cm^2$. DPF, as noted, is reference to denier per fiber (grams/9000 meters of fiber) and thickness is in millimeters (mm). As can be seen, thickness has been found to be a relatively more important variable in the ability of the bicomponent fibers to pick-up the dryer sheet chemical additive. Fiber size is relatively less important. Accordingly, it can be seen that relatively high levels of pick-up of the chemical additive may be achieved at a thickness of 0.15-0.26 mm. However, as noted, the present disclosure contemplates a thickness range of greater than 0.10 mm to 0.40, as such thickness levels have been found adequate for a given dryer sheet application with respect to coating characteristics and associated loft. Accordingly, it may be appreciated that with respect to the dryer sheet material disclosed herein, it may be prepared from a bicomponent fiber, thermally bonded by the outer, relatively lower melting fiber component. The bicomponent fiber so configured may also provide a basis weight of between 10-30 grams per square meter, including all values and increments therein.

The description illustratively sets forth the presently preferred disclosure embodiments. We intend the description to describe these embodiments and not to limit the scope of the invention. Obviously, it is possible to modify these embodiments while remaining within the scope of the following claims. Therefore, within the scope of the claims one may practice the invention otherwise than as the description specifically shows and describes.

What is claimed is:

1. A substrate for use as a laundry dryer sheet, comprising:

a non-woven web including bicomponent fibers and including a belt side and jet side, wherein said bicomponent fibers comprise two or more polymers, wherein one portion of the bicomponent fiber comprises a polymer having a melting temperature, $Tm_1$, and another portion of the bicomponent fiber comprises a polymer having a melting temperature, $Tm_2$, wherein $Tm_1<Tm_2$ and wherein said bicomponent fibers have a denier of 1.2 to 3.0, and the web has a thickness of greater than 0.10 mm and up to 0.40 mm and a fuzz factor on said belt side and/or jet side of less than 0.90, wherein said web absorbs a fabric treating composition at a level between 6.0 grams/$m^2$ to 50 grams/$m^2$.

2. The substrate of claim 1, wherein said thickness is 0.15 mm to 0.26 mM.

3. The substrate of claim 1, wherein said web absorbs a coating at a level of 25.0 grams/$m^2$ to 45 grams/$m^2$.

4. The substrate of claim 1, wherein said web has a belt side and/or jet side fuzz factor of 0-0.89.

5. The substrate of claim 4, wherein said web has a belt side and/or jet side fuzz factor of 0.10-0.30.

6. The substrate of claim 1, wherein said bicomponent fibers are configured as one or more of sheath/core, side-by-side, islands-in-the-sea, segment/pie, matrix-fibril or striped configuration.

7. The substrate of claim 1, wherein one of said two or more polymers in said bicomponent fibers comprises poly(ethylene terephthalate).

8. The substrate of claim 1, wherein the value of $Tm_2$ minus the value of $Tm_1$ is between 15° C. and 60° C.

9. A process for providing a substrate for use as a laundry dryer sheet, comprising:

providing two or more polymers, wherein at least one of said two or more polymers has a melting temperature, $Tm_1$, lower than the melting temperature, $Tm_2$, of another polymer of the two or more polymers;

extruding said two or more polymers together to form bicomponent filaments, wherein said one polymer having a lower melting temperature, $Tm_1$, forms at least a portion of the outer surface of said filament;

positioning said bicomponent filaments onto a conveyor to form a web, said web having a jet side and belt side; and passing said web past a source of heat such that said lower melting temperature polymer softens and bonds said bicomponent filaments together, wherein said bicomponent filaments have a denier of 1.2 to 3.0, and the web has a thickness of greater than 0.10 mm and up to 0.40 mm and a jet side and/or belt side fuzz factor of less than 0.90.

10. The process of claim 9, further including the step of applying a coating to said web, wherein said coating is present at a level of between 6.0 grams/$m^2$ to 50 grams/$m^2$.

11. The process of claim 9, wherein said thickness is 0.15 mm to 0.26 mM.

12. The process of claim 9, wherein said web absorbs a coating at a level of 25.0 grams/$m^2$ to 45 grams/$m^2$.

13. The process of claim 9, wherein said web has a belt side and/or jet side fuzz factor of 0-0.89.

14. The process of claim 13, wherein said web has a belt side and/or jet side fuzz factor of 0.10-0.30.

15. The process of claim 9, wherein said bicomponent fibers are configured as one or more of sheath/core, side-by-side, islands-in-the-sea, segment/pie, matrix-fibril or striped configuration.

16. The process of claim 9, wherein one of said two or more polymers in said bicomponent fibers comprises poly(ethylene terephthalate).

17. The process of claim 9, wherein the value of $Tm_2$ minus the value of $Tm_1$ is between 15° C. and 60° C.

* * * * *